US006390470B1

(12) United States Patent
Huang

(10) Patent No.: US 6,390,470 B1
(45) Date of Patent: May 21, 2002

(54) CARD GAME PINBALL AMUSEMENT DEVICE

(75) Inventor: Sming Huang, Monmouth, NJ (US)

(73) Assignee: American Alpha Inc., Monmouth Junction, NJ (US)

( * ) Notice: Subject to any disclaimer, the term of this patent is extended or adjusted under 35 U.S.C. 154(b) by 0 days.

(21) Appl. No.: 09/801,457

(22) Filed: Mar. 8, 2001

(51) Int. Cl.[7] ..... A63F 7/02

(52) U.S. Cl. ..... 273/121 R; 273/121 A; 273/119 R; 273/119 A; 273/118 R; 273/118 A

(58) Field of Search ..... 273/118 R, 118 A, 273/119 R, 119 A, 121 R, 121 A, 13, 123 R, 123 A, 127 R, 108

(56) References Cited

U.S. PATENT DOCUMENTS 4,015,847 A * 4/1977 Myers ..... 273/108.1
5,016,879 A * 5/1991 Parker et al. ..... 273/121 B
5,121,919 A * 6/1992 Martti ..... 273/118 A
5,342,049 A * 8/1994 Wichinsky et al. ..... 273/119 A
5,904,352 A * 5/1999 Takemoto ..... 273/121 B
6,029,973 A * 2/2000 Takemoto ..... 273/121 B
6,203,009 B1 * 3/2001 Sines et al. ..... 273/120 A
6,279,904 B1 * 8/2001 Huang ..... 273/118 A

* cited by examiner

*Primary Examiner*—Raleigh W. Chiu
(74) *Attorney, Agent, or Firm*—John Lezdey & Assoc

(57) ABSTRACT

A card game pinball amusement device for playing a card game. The playing field contains four slots with sensors for determining the suit of the cards and at least 12 slots with sensors representing the value of the cards. The game is played by launching a ball along an inclined playing field to determine cards used in poker, blackjack and the like.

17 Claims, 4 Drawing Sheets

CARD GAME PINBALL AMUSEMENT DEVICE

FIELD OF THE INVENTION

The present invention relates to a card game pinball amusement device which simulates a card game using images of cards displayed on a graphic display device.

BACKGROUND OF THE INVENTION

Poker game machines to enjoy poker games by oneself are installed in amusement centers. The poker game machine is a device to perform what is called a draw poker game, in which an unnecessary card(s) among five cards displayed on a screen is (are) exchanged with another card(s) and in which from a combination of the obtained cards, the value of hands such as royal flush, full house is made and in which in accordance with a respective bet to the combination, coins or the like are paid out.

A large number of players play poker games to kill time. However, because the poker game is a simple game and the game is over in a short period of time, there is a problem that the players are not able to kill time, as they desire. Further, because of the simple game, a large number of players lose interest in games.

Pinball machines have numerous configurations that are well known in the art. It is conventional practice in a pinball machine apparatus to modify the structure on the game surface, the design and the score value of different targets in order to revive the incentive of practiced players without changing the principal of the game.

There are many commercially available pinball machines that incorporate various scoring indicators, lights, graphics and sound. These machines include mechanical three-dimensional figures that communicate visually and audibly with a player.

U.S. Pat. No. 5,112,049 to Borg, which is herein incorporated by reference, discloses a pinball machine wherein a section of the playing field is changed by rotating the section to expose different components.

U.S. Pat. No. 5,405,142 to Arad, which is herein incorporated by reference, discloses a pinball machine having provisions for translating a ball in play throughout a plurality of locations. There is also provided an audio system to provide a speaking effect in response to different play conditions.

SUMMARY OF THE INVENTION

According to the present invention, there is provided a card game pinball machine having a slanted playing field and a plurality of representative card playing slots arranged on the playing field to determine suits and/or about the bottom of the playing field to determine value. The card playing slots are provided with sensors for detecting a ball that enters the slot. A microprocessor is provided, which is activated when a ball enters a slot to record a score and display the card played. Means are provided on the playing field to translate a ball in play throughout a plurality of locations thereon.

Advantageously, audio means are provided in association with the microprocessor for providing speaking and/or sound or light effects in response to different play conditions.

It is therefore an object of the invention to provide a card game pinball game apparatus.

It is a further object of the invention to provide a card game pinball game apparatus, which alters the playing field to challenge the skill of the user.

It is yet another object of the invention to provide visual and sound effects, which respond to the playing conditions.

It is still another object to provide a card game in which the essence of a poker game, blackjack game or the like is provided.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
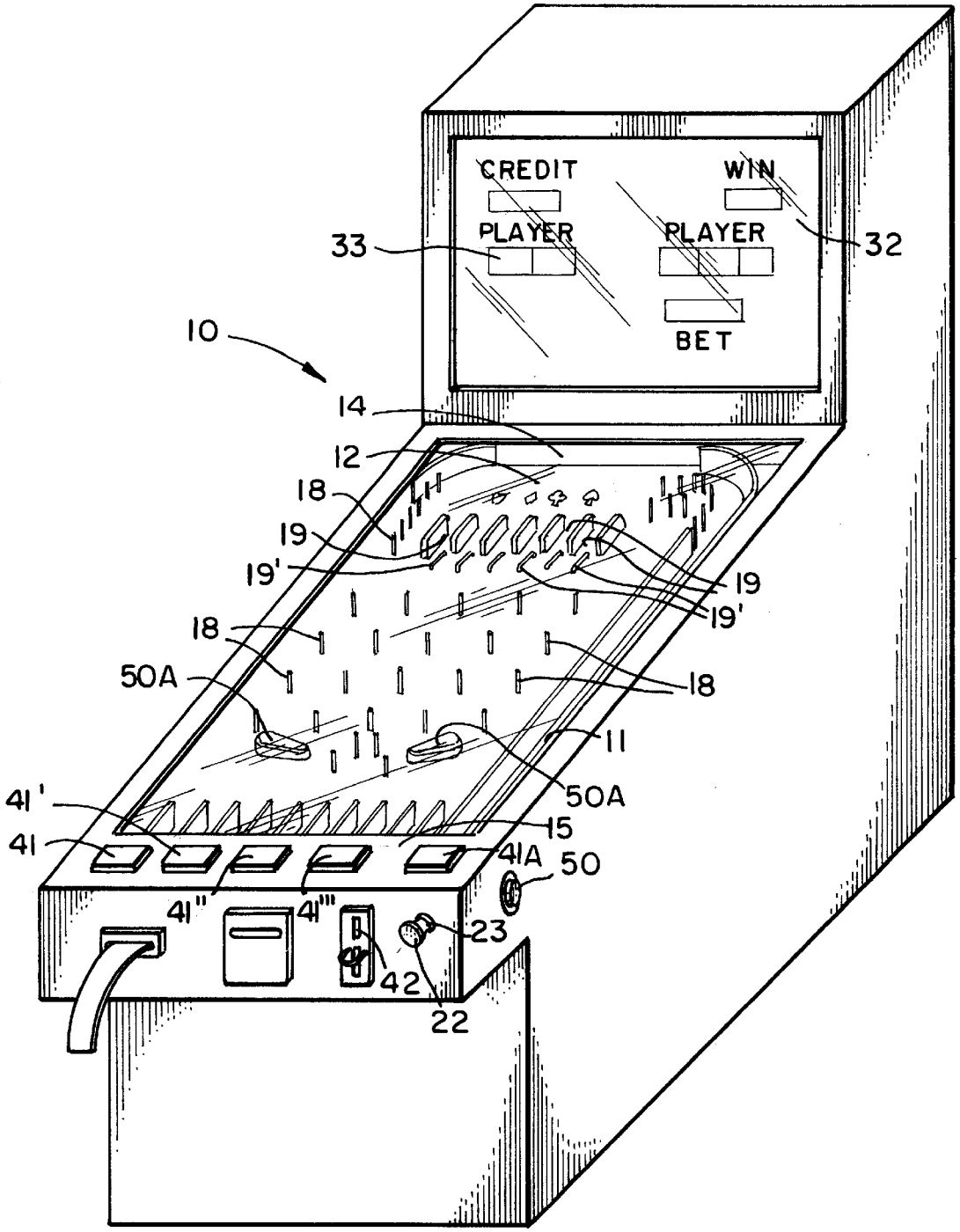
FIG. 1 is a perspective view of a card game pinball machine of the invention.
Figure 2:
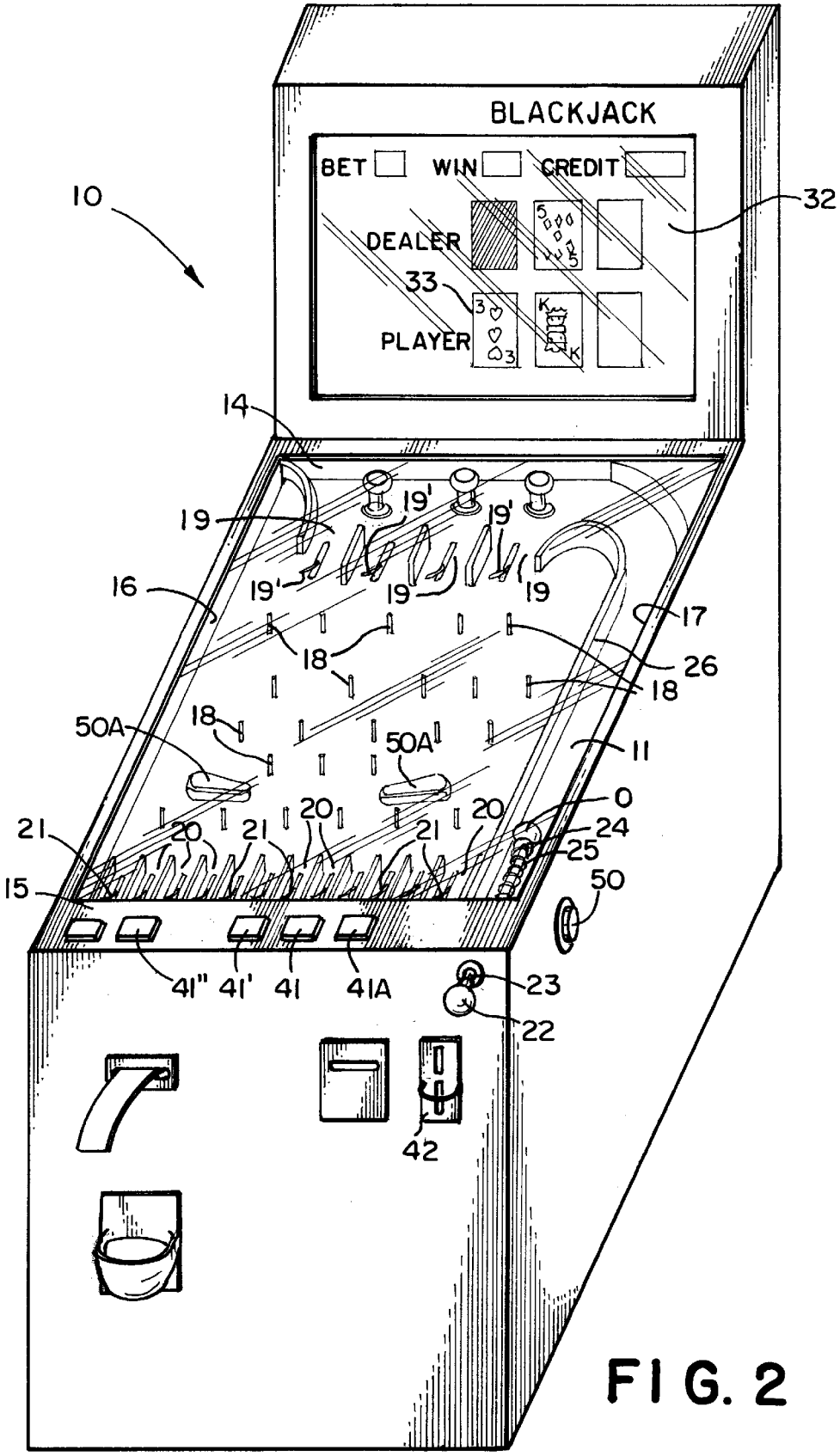
FIG. 2 is a perspective view of a blackjack game apparatus according to the invention

As seen in FIGS. 1 and 2, in the simplest form of the invention there is provided a pinball apparatus 10 comprising a housing 11 having an upper face 12, which form the sloping playing field. The playing field is conventionally covered by a transparent glass pane 13.

The housing 11 is defined by a first or top wall 14, a rear wall 15 and side walls 16 and 17. The playing field 12 is inclined downwardly toward the rear wall 15 so that a ball will roll downwardly because of gravity.

The playing field has a plurality of path altering pins 18 to accommodate various ball path-altering provisions. The playing field may also contain first ball path altering slot or slots 19 formed by walls 28 that contain sensors 19', which define the suit of the cards (heart, diamond, club, spade). The pins 18 may also comprise various fixed and elastic, active and passive targets as common in the game.

Along the bottom wall 15 there is a plurality of slots 20, formed by walls 20A, which contain sensors 21 that can sense a ball entering one of the slots 20. Slots 20 define the value of the card (ace, two, three, etc.) and, optionally, card suits.

Preferably, the slot or slots 19 define a card suit and the bottom wall slots 20 define a card value.

A ball launch guide 20', is disposed near one side of the housing 11. Launch guide 20' is bound by a wall 22 which is offset a nominal distance from side wall 17 to form a ball launching channel. A spring loaded pull knob 23 having a grasping handle 22, ball contact end 24, and an intermediate body having a compression spring 25, is collinearly mounted through housing 11 along the longitudinal extent of launch guide 20'. When knob 23 is fully extended, ball 0 exits launch guide 20', and is first expelled by releasing knob 23. Once ball 0 exits launch guide 20', it is in play and may come into contact with wall 14, pins 18 and enters first slots 19 which define the suit of the card. The object of the game is to enter into a selected slot 19 and 20. Each slot 20 is provided with a sensor 21, which is associated with a microprocessor that contains a program which acts with a sensor 21 in the slots 20. In the case of blackjack, the microprocessor provides the dealer with a value for two cards and for the player a value for one card. The player's skill in being able to enter a given slot 19 and 20 will decide the remaining card value and suit.

Along the upper part of the housing 11 and along the top wall 14 is a display board 32, which is associated with a microprocessor to provide the score and a visual display on screen 33 in accordance with the play on the playing field and the sensors 19' and 21 activated by a ball 0.

The microprocessor is also programmed to display images of cards, coin insertion, coin payout, etc. If the ball 0 enters a slot 20, the sensor signals the microprocessor, which senses the display board 32 and displays the score. Generally, there are thirteen slots 20 on the playing field and optionally an additional slot for a joker or wild card that is an LED so as to display that slot when scoring occurs.

Along the playing field are a plurality of pins 18, which randomly direct the ball to slots 19 and 20. The size and shape of the pins as well as their positioning on the playing field have an effect on the ball and the odds of a ball going to a specific slot.

Upon inserting a number of coins into the slot 42 prior to playing the game, a sensing means senses the coins inserted so as to provide pulse signals corresponding to the number of coins which are transmitted to and counted by a detection unit and by pressing buttons 41A, a signal is sent to activate the reel control unit 61 which provides a signal to the microprocessor to activate the game.

The playing field may be provided with active and/or inactive pins and bumpers which not only provide scoring but also activate a video or sound program. The balls 0, as they roll down the inclined plane, randomly bump into pins or bumpers to deflect the path of the ball. At the bottom of the playing field here may be provided thrust levers or flippers 50A controlled by buttons 50 which can direct the ball 0 into play for different slots or direction. The length of the flippers can be as conventionally used in a pinball apparatus.

The playing field at the back wall is provided with a gutter or return mechanism which is conventional in the art. One such mechanism is described in U.S. Pat. No. 5,464,213 which is herein incorporated by reference.

The game is played in a manner similar to known pinball machines. In the preferred embodiment, the general rules are as follows: The player gets five balls for poker and one or more balls for blackjack. Scoring is made by having a ball enter into one of suit slots 19 and then into one of slots 20. The game can be started by placing coins into slot 42 whereby coin insert and detection unit 60 signals the CPU50. Alternatively, a start button 41A is pressed. The CPU50 has a control unit which illuminates the game board by LED's, an LCD for visual display and the audio units.

The player selects the desired play by pressing one of the buttons 41, 41', 41" after the hands are displayed for the dealer and player. Button 41 is the hit button for another card. Button 41' is the stay button, and 41" is the double button. The start button 41A causes the release of a ball 0 into launch channel 11.

The ball 0 is put into play by extending and releasing knob 32. The ball in play can be controlled by the skill of the player in being able to control the direction of the ball by a controlled vibration of the machine. Optionally, a tilt mechanism 66 may be provided to control the degree of vibration. If the tilt detector is activated, the game is over.

The ball 0 travels downward toward the back wall 15 so as to enter one of the first set of slots 19 and activate one of the sensors 19' which are lit. According to the game, the direction of the ball is determined by the skill of the player in using the flippers 50A controlled by button 50 and in vibrating the apparatus.

The projected images and sounds can be triggered by one or more targets or pins 18 which are electrically connected with the CPU50 to trigger an image or sound upon impact with a ball 0. There may be provided a projector (not shown) which comprises a cassette with an endless film which cyclically produces an image on the display. There is further the possibility to trigger image reproduction and sound or change when the sensors 19', 21 have been activated.

The game of blackjack can be played by releasing a ball to first go into one of the slots 19 to decide the suit of the card of slot 20. The slots 19 may have permanent suits assigned or be randomly selected by the microprocessor whereby all slots display the same suit.

The card value slots will be displayed by LED or LCD after the game starts. The card value slots can be permanent or randomly selected. For blackjack, the computer will deal four cards including one dealers card with the face down. The player could then shoot the ball to determine the face down card of the dealer. Alternatively, the dealer's cards can be displayed and the player will shoot the ball to decide the down card.

After the down card is played, the play can go into a second program with regard to a hit or stay. With a hit, the player will then play another ball for the value of the additional card. The dealer will generally stay with a card's value of seventeen or greater.

A similar arrangement can be made for the game of baccarat.

Figure 3:
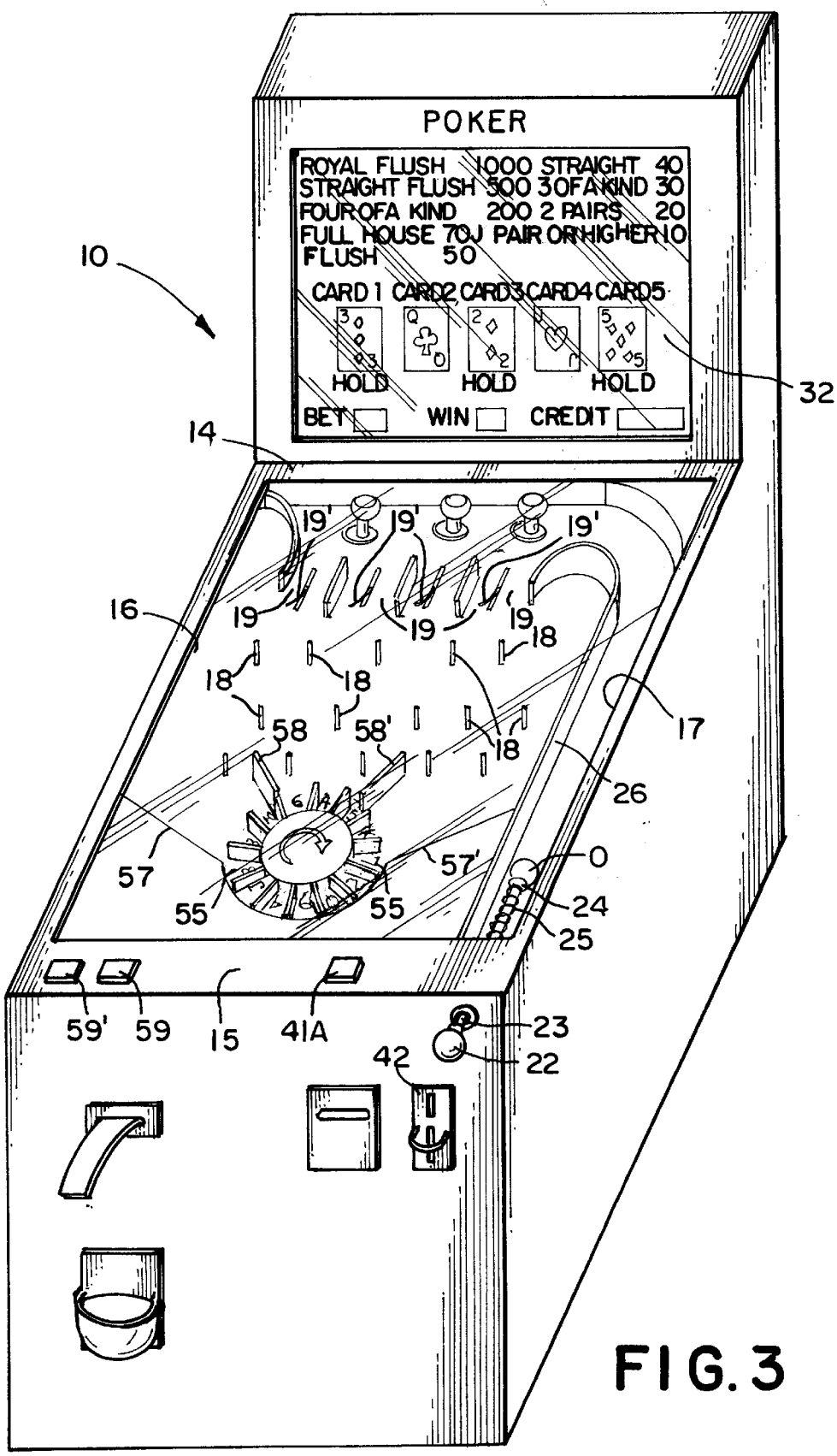
FIG. 3 is a perspective view of further embodiment of the invention.

FIG. 3 shows another embodiment of the invention wherein the bottom slots are on a carousel 55. The carousel is controlled by a microprocessor which randomly selects which slots 55 are accessible by a played ball 0. Each of the slots 55 has a sensor (not shown) which senses a ball 0 entering and falling into ball return 56. Walls 57, 58 and 57', 58' from slots which access one or more of the card value slots 55.

In a poker game, each of the slots may comprise the same suit determined by the microprocessor or one of each of the card suits.

For draw poker, there may be provided a button 59 which holds one or more cards and a draw button 59' which changes the card's total value when it enters one of the slots on the carousel.

The game can contain the options programmed into the microprocessor whereby the initial cards are drawn by the microprocessor or obtained by playing the game with five shots for each and then playing the options.

The machine can alternately be provided with a single forward slot which suit is determined by the microprocessor, or the carousel can comprise a multiplicity of slots which are for both suit or value of the cards.

Figure 4:
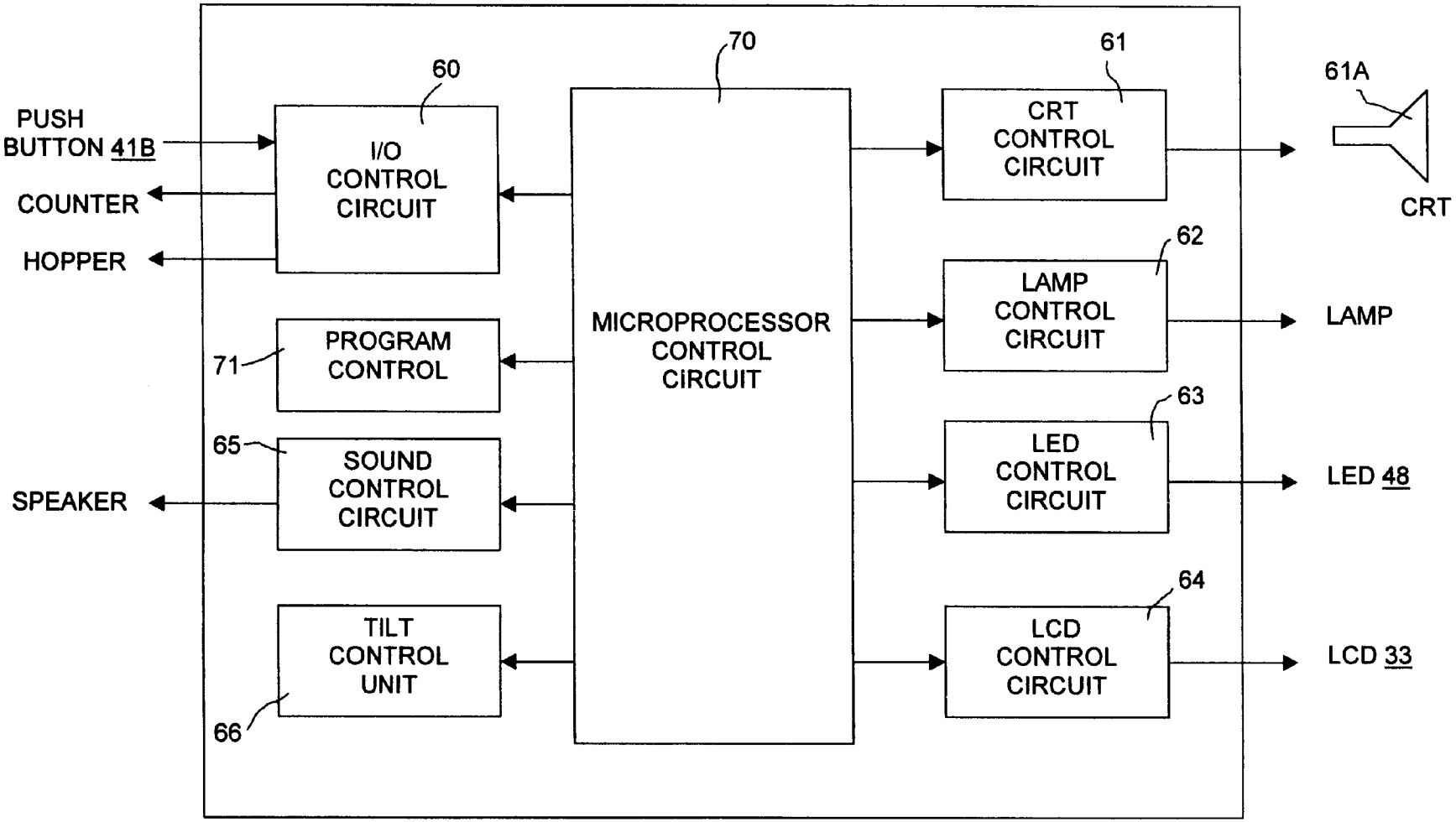
FIG. 4 is a block diagram showing a configuration of a card game pinball machine according to the present invention.

FIG. 4 is a block diagram showing a configuration according to the present invention wherein a microprocessor or CPU 50 is a memory device in which every processing program is stored. CPU 50 controls the LCD display 42, a coin insertion and detection unit 60 for detecting the insertion of a coin and includes a coin payout unit for paying out coins upon activation of button 41B.

The CPU has a motor control unit 61 which controls the activation of the sensors 19', 21, a lamp control unit 62 which illuminates the apparatus upon insertion of a coin, a LED control unit 63 for the LED's 48 of the sensors 19', 21 and other illuminations, a LCD control unit 64 for the video display 33 which also contains a graphic RAM for storing graphic data to be sent to the video display 33 and a character ROM in which character data are stored, and a sound control unit 65 which stores sounds for different activities on the video display 33.

The card game device of the invention contains a memory device 71 in which every processing program is stored, a microprocessor 70 for controlling operations of the processing programs, a CRT control circuit 61 with a CRT display for images of cards, a coin insertion detector 41B for detecting the insertion of coins, a counter of coins and a payout hopper.

The CRT control circuit 61 comprises a CRT controller for controlling the images to CRT 61A, a graphic RAM for storing graphic data to be sent to the CRT 61A and a character ROM in which character data are stored.

The microprocessor runs a movement determining program to determine whether any of the five cards displayed on the screen has the same number or suit as any of the five cards initially displayed so that the further display of the same card is eliminated from the screen and a new card randomly drawn is substituted or a new card can be determined by a further ball. Although the embodiment of five cards is shown on the display, the number of cards can be seven or more depending upon the game.

The player may choose to continue to play based on the cumulative score or he may choose to pay out. The machine may be programmed to dispense tickets or coins.

While the invention is susceptible to various modifications and alternative forms, specific embodiments thereof have been shown by way of example in the drawings and will herein be described in detail. It should be understood, however, that it is not intended to be limited to the particular embodiments shown, but on the contrary, the intention is to cover all modifications, equivalents and alternatives falling within the spirit and scope of the appended claims.

What is claimed is:

1. A card game pinball machine for playing a card game, said machine having a housing with a top wall, a rear wall and a pair of side walls and of which the upper face is designed as a playing area, said housing having means for translating at least one ball throughout a plurality of locations therein, means for launching said ball for play action and means for displaying card suit and card value responsive to said play action, said play area being inclined downwardly so that a ball will roll downwardly because of gravity and having a multiplicity of slots about the rear wall having means for sensing said ball for determining the value or suit of a card represented by said slot.

2. The machine of claim 1 comprising at least 12 slots about the rear wall.

3. The machine of claim 1 including a multiplicity of slots about the front wall having means for sensing said ball for determining the card suit represented by said slots.

4. The machine of claim 3 wherein slots about the front wall comprise at least four.

5. The machine of claim 1 wherein said means for scoring and controlling the process of said game comprises a microprocessor.

6. The machine of claim 1 wherein the slots about the rear wall are on a rotary carousel.

7. The machine of claim 6 wherein said carousel is rotated and controlled by said microprocessor.

8. The machine of claim 1 wherein said apparatus further comprises value determining means and five balls are played, said value determining means determining whether the five balls played form a hand in poker.

9. The machine of claim 1 wherein said apparatus comprises value determining means for balls played in a hand in blackjack.

10. The machine of claim 1 wherein said first slots are selectively activated to represent the same suit.

11. The machine of claim 1 including a tilt detector.

12. The machine of claim 1 including flipper means.

13. The machine of claim 1 comprising up to 13 rear wall slots containing sensing means, one of said slots comprising a wild card.

14. The machine of claim 1 including means for providing a visual display and sound when a ball enters a selected slot or a selected value is obtained.

15. The machine of claim 1 including a movement determining means for determining whether a card is moveable and a value determining program for determining whether the plural cards displayed form the hand in a card game stored in the memory in a microprocessor.

16. The machine of claim 1 including means for eliminating cards from further display whereby the same card value and suit is displayed only once.

17. The machine of claim 1 wherein the game of blackjack is simulated and cards are selected for a dealer, and at least one ball is played to determine the value of a card for a player.

* * * * *